US007205830B2

(12) United States Patent
Gangasani et al.

(10) Patent No.: US 7,205,830 B2
(45) Date of Patent: Apr. 17, 2007

(54) ANALOG MOS CIRCUITS HAVING REDUCED VOLTAGE STRESS

(75) Inventors: Gautam Gangasani, Hopewell Junction, NY (US); Louis L. Hsu, Fishkill, NY (US); Karl D. Selander, Hopewell Junction, NY (US); Steven J. Zier, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 63 days.

(21) Appl. No.: 10/905,436

(22) Filed: Jan. 4, 2005

(65) Prior Publication Data

US 2006/0145751 A1 Jul. 6, 2006

(51) Int. Cl.
*G05F 1/10* (2006.01)

(52) U.S. Cl. ..... 327/543; 327/389

(58) Field of Classification Search ..... 327/541, 327/543, 546; 323/315

See application file for complete search history.

(56) References Cited

U.S. PATENT DOCUMENTS 5,369,312 A 11/1994 Oh et al. ..... 327/545
5,726,589 A 3/1998 Cahill et al. ..... 326/81
6,377,075 B1 4/2002 Wong ..... 326/83
6,630,818 B1 * 10/2003 Comer et al. ..... 323/315
6,825,710 B2 * 11/2004 Moyal ..... 327/543

* cited by examiner

*Primary Examiner*—My-Trang Nuton
(74) *Attorney, Agent, or Firm*—Steven Capella; Daryl Neff

(57) ABSTRACT

Circuits and methods are provided for reducing the voltage stress applied to the drain to source conduction path of an FET and/or to reduce the stress to the gate oxide of an FET which may have a thin gate oxide. Thus, in a current mirror circuit disclosed herein, a first field effect transistor (FET) has a first gate and a first drain, in which the first drain is conductively connected to a current source for conducting a first current. The current mirror circuit also includes at least one second FET having a second gate conductively connected to the first gate, in which the second FET is operable to output a second current in fixed proportion to the first current. A switching element having a first conductive terminal is connected to the first gate and to the second gate, the second conductive terminal being connected to the first drain of the first FET. A switching network is operable to controllably switch the first and second FETs and the third switching element between a powered on state in which the first and second currents are conducted and the third switching element is conducting, and a powered off state in which the first and second currents are not conducted and the third switching element is nonconducting such that the same drain to source voltage stress is applied to both first and second FETs.

6 Claims, 9 Drawing Sheets

ANALOG MOS CIRCUITS HAVING REDUCED VOLTAGE STRESS

BACKGROUND OF THE INVENTION

The present invention relates to analog integrated circuits, especially integrated circuits implemented using insulated gate field effect transistors (IGFETs).

Integrated circuits ("chips") which implement some types of mixed signal systems include a digital core having a CPU and/or a digital signal processor (DSP), various memory blocks, and analog interface circuitry. In such case, the analog interface circuitry typically includes input/output circuitry, a digital-to-analog converter and/or an analog-to-digital converter, and a radio frequency front end interface, among others. Other such chips have an analog core at their centers, the analog core including a receiver complex and/or a transmitter complex, which is surrounded by digital logic for a variety of functions. In such chips, both the digital and analog circuitry are constructed from insulated gate field effect transistors (IGFETs) fabricated in a technology, e.g., referred to as "complementary metal oxide semiconductor" (CMOS) technology. Because CMOS was traditionally designed to support digital circuitry, the analog circuits of such mixed signal chips are forced to cope with the constraints of digital circuitry which dictate the evolution of CMOS technology. For example, one constraint of digital circuit design is the scaling of the power supply voltage with increasing circuit density and speed. Unfortunately, in analog circuits, harmonic distortion introduced by transistors increases drastically with a reduction in the power supply voltage. On the other hand, alternating current (AC) parameters such as junction capacitances and gain-bandwidth products improve with technology evolution, allowing better RF performance.

For a given power budget, it has been found that the performance of analog circuitry decreases when advancing from one generation of technology to the next, due to the reduction in the power supply voltage. Often, this occurs because the threshold voltages of the transistors cannot be scaled in proportion with the scaling of the power supply voltage. To maintain the anticipated performance, one must achieve the same difference in peak voltage above the threshold voltage as in the prior technology generation. However, such can only be achieved by not scaling the power supply voltage to the same degree as for the digital circuitry of the chip, or by reducing the threshold voltage. Either such way causes the power consumption to increase. In fact, an increase in the performance of analog circuits generally comes at a cost of higher power consumption.

Another concern of mixed signal chips is gate leakage current. Gate leakage current mainly depends on the voltage bias between the gate and source, referred to as "gate to source bias," and the size of the gate. Undesirable results of gate leakage currents include the need to account for an input bias current at the gate of the transistor, gate leakage mismatch and shot noise. Here, an input bias current caused by gate leakage in an MOS transistor is similar to the base current of a bipolar transistor, except that the conductivity of the transistor depends upon the width to length ratio of the MOS transistor, as well. The input impedance of a MOS device consists of the conventional input capacitance and a parallel tunnel resistance due to gate leakage. In a 90 nm MOS technology, for signal frequencies higher than 1 MHz, the input impedance is predominantly capacitive and the MOS transistor behaves as a conventional MOS. For this reason, MOS transistors having thin oxide capacitances are not suitable for certain low-frequency applications like PLL filters and hold circuits. However, for signal frequencies above 1 MHz, the input impedance becomes predominantly resistive and the gate leakage dominates. At such higher frequencies, gate leakage mismatch exceeds conventional threshold voltage mismatch tolerances.

Matching generally limits the achievable level of performance on analog circuits. One way to reduce threshold voltage-related mismatch is to increase the area of the MOS transistors. However, gate leakage takes on the appearance of an extra spread source. This, in turn, places an upper bound on the amount of increased area that can be used to decrease the threshold mismatch. It is found that, with increased transistor area, the conventional threshold spreading contribution decreases. However, at the same time, the gate leakage spread contribution increases. Thus, the maximum usable transistor area is limited by the spreading of the gate leakage.

The problem only becomes more significant for the 90 nm and 65 nm generations, wherein the maximum area is about 104 $\mu m^2$ and 103 $\mu m^2$, respectively. To reduce gate leakage, one strategy is to provide a higher supply voltage on critical parts of the circuitry, so that these circuits can be constructed using transistors which have thicker gate oxides. The lifetime of an MOS transistor is dominated by the magnitude of the electric field in vertical and lateral directions, and the electric field across the junctions. Three life-time-determining mechanisms regarding to these fields are denoted as oxide breakdown, hot-carrier degradation and junction breakdown, respectively.

Relaxing design ground rules to trade performance for higher yield and reliability is one way of responding to the aforementioned challenges. However, other ways of responding are to use circuit solutions to deal with problems such as avoiding gate oxide breakdown due to high gate to substrate stress, as well as the shifting of the MOS threshold voltage level due to high electrical field induced hot carrier injection, etc. Cascade circuits are one known way of protecting devices from high voltage stress in circuits having outputs that swing from rail to rail. However, cascade circuits are unsuitable for use in many types of analog circuits, because signals in analog circuits do not swing from rail to rail. More new techniques are described in the following sections.

U.S. Pat. No. 6,377,075 to Wong describes one way for addressing hot carrier degradation and gate oxide breakdown in a digital signal circuit as opposed to an analog signal circuit. FIG. 10 thereof shows a ten-transistor inverter. The inverter circuit addresses high gate stress applied by 10 V power supply Vdd to the input devices M1, and M4 by adding two extra devices M6, M5 and two extra power supplies denoted therein as "pgate" and "ngate". Two more devices M2 and M3 are added for reducing the stress applied to the input devices M1 and M4 due to hot carrier injection. Still other devices M8, M9 and M7 and M10 are added to decrease the amount of gate leakage currents below the threshold voltage ("sub-threshold leakage") of transistors M1 and M4. While addressing the problems of gate stress and hot carrier injection, the circuit described in this patent comes at a cost of increased circuit size, complexity and power consumption.

U.S. Pat. No. 5,726,589 to Cahill et al. describes another way of addressing hot carrier related degradation. FIG. 11 of that patent illustrates an NFET device 12 which is protected from hot-carrier degradation by circuitry which delays the transistor from turning on until the drain to source voltage of the transistor has dropped below the voltage at which hot carrier injection is most prevalent. Such delayed turn-on time could lead to the transistor having decreased speed. Accordingly, a better way is needed to protect against hot carrier degradation and also maximize transistor speed.

U.S. Pat. No. 5,369,312 to Oh et al. describes another way of addressing hot carrier degradation. FIG. 12 of that patent shows a circuit in which two transistors Q1 and Q2 are stacked in cascade, and a third transistor Q3 operates to bias an intermediate node voltage at roughly half of the level of the supply voltage. Stacking devices in cascade configuration tends to work well only when the level of the supply voltage is sufficiently higher than the sum of the threshold levels of the stacked devices. Typically, the threshold voltages are 0.6 V or more. Thus, when the power supply voltage level is lower than some level, e.g., about 2.0 V, the reduced "headroom" afforded to differential amplifier type analog circuits can cause them to malfunction. As the power supply voltage is constrained to low levels and further scaled with the introduction of newer technologies, there comes a point when the stacking of transistors in cascade cannot be used with transistors having typical threshold voltages.

The problems of the prior art are apparent from a study of particular types of circuitry. FIG. 1 illustrates a current mirror circuit 10 according to the prior art. The current mirror circuit 10 outputs reference currents I1, I2, I3 which are generated as "mirror" currents in fixed proportion to a source current I0. When the threshold voltage and the size of each PFET Pi (i=1 to n) equals the threshold voltage and the size of PFET P0, then the reference currents I1, I2, I3, . . . In all have the same magnitude and sign as I0.

The current mirror circuit 10 is turned on and turned off by a power down control signal PDWN. The current mirror circuit is powered on when PDWN is held at ground. Under such condition, all of the pull down n-type FETs ("NFETs") Ni (i=1 to n) are turned off and the pull up p-type FET ("PFET") Px is turned off. However, when the current mirror circuit 10 remains in the powered down condition for a long time, or is frequently switched between the powered on and the powered down condition, hot carrier degradation and/or gate to substrate bias eventually cause the threshold voltages of the PFETs P1 to Pn to shift to a different level than that of P0. This occurs because of the different conditions under which PFET P0 is biased than the PFETs P1 to Pn in the powered off condition. When the current mirror circuit 10 is powered down, the gate to drain bias voltage of the PFETs P1 to Pn is at the power supply voltage Vdd, while the gate to drain bias voltage of PFET P0 is at zero volts due to the conductor which ties the gate of P0 to its drain. If such condition is maintained for a sufficiently long time, the threshold voltage (Vt) of the PFETs P1 through Pn shift to a different level than the threshold voltage of PFET P0, causing the magnitude of the reference currents I1, I2, etc. output by the PFETs P1 to Pn to change to a value different than the reference current I0 output by PFET P0.

In another example illustrated in FIG. 2, a reference voltage generator circuit 20 is arranged to apply little stress in the form of a drain to source bias voltage to an n-type FET N2 ("NFET") which has a thin gate oxide. The circuit 20 generates a reference voltage level (Vdd–i22×R1) by a voltage drop of a current i22 across the resistor R1 from a power supply Vdd. Here, current "i" is mirrored from a reference current i24 conducted by a first NFET N1 having a gate terminal and a drain terminal which are both conductively connected to a gate terminal of a mirror NFET N2. In order to protect the mirror NFET N2 from experiencing high Vds stress, an additional resistor R2 is provided.

Since NFET N2 has a thin gate oxide, the drain to source voltage Vds needs to be maintained at a value of less than one volt. However, when the power supply voltage Vdd has a value such as 1.9 V, resistor R2 requires large size, which occupies a large area of an integrated circuit containing the voltage generator circuit 20. Also, the source NFET N1 and the mirror NFET N2 are stressed differently when the voltage generator circuit 20 is powered down. As in the above-described example, the gate of NFET N1 is tied to the drain of NFET N1, but this is not the case with NFET N2. For this reason, the resulting different gate to source bias voltages applied to NFET N1 and NFET N2 may cause the threshold voltage of NFET N2 to shift which can cause the transistors' threshold voltages to mismatch. Another problem of the voltage generator circuit 20 is that the PFET switch P1 adds inaccuracy to the reference voltage output level due to its contribution to resistance in the conductive path, adding an imprecise, variable amount of resistance to the circuit which is not easy to model. Accordingly, it would be desirable to eliminate PFET P1 from the circuit.

In another example illustrated in the prior art diagram of FIG. 3, a problem is highlighted of a conventional differential amplifier 30 such as an operational amplifier. To achieve high performance, low-Vt (low threshold voltage) and thin-oxide NFETs can be used for the pair of input devices T0 and T1. One reliability concern is that when the differential amplifier 30 is powered on the gate to substrate biases applied to NFETs T0 and T1 are too high, given that the substrate node of the NFETs is tied to ground. When the differential amplifier 30 is powered down, T0, T1 as well as the tail device T2 are subjected to high drain to source voltages (high Vds stress), since both input signals AN and AP, as well as the bias voltage at the gate of the tail device T2 are held at ground. These biasing conditions place voltage stresses on the transistors T0, T1 and T2 which can lead to insufficient reliability.

As mentioned above, in some analog circuits, good performance cannot be obtained when stacking FET devices in cascade which have typical threshold voltage levels such as 0.6 V. This is particularly true in circuits where the power supply voltage level is low in relation to the threshold voltage of the devices used therein. In some such circuits, attempts are made to improve the relationship by using low-Vt NFETs and PFETs in place of some of the cascaded FETs. One such example is shown in FIG. 4, in which a prior art hysteresis comparator 40 includes PFETs P6 and P7, which are stacked in cascade with NFETs N8 and N9, respectively. In such circuit, a first PFET P15 controls whether the comparator 40 is operated in AC or DC mode operation. The second PFET P6 is used to generate a current in fixed proportion to the current flowing through PFET P4, i.e., as a mirror current. In this circuit 40, NFETs N1 and N2 are low-Vt devices to which input signals INN and INP are applied, respectively. NFETs N8 and N9 function as tail devices for providing a current source to pull up or pull down the voltage at the output node indicated at "Out". In this design, other than the PFET P15 and the NFETs N8 and N9, all of the transistors are low-Vt, thin-oxide devices.

With continued reference to FIG. 4, in order that current be accurately tracked from first stage transistors P4, N2 to the second stage at transistor P6 and from first stage transistors P3 and N1 to transistor P7, the transistors P6 and P7 are low-Vt devices. While such a design results in improved matching between the transistors, long-term reliability is not optimum in the circuit 40 because the low-Vt PFETs P6 and P7 are subjected to high drain to source bias (high Vds stress) due to the output node swinging from rail to rail.

When the output is at ground, the low-Vt P6 device is stressed to the full amount of the power supply voltage Vtr. The high drain to source voltage stress makes hot carrier injection a concern for the low-Vt devices P6 and P7.

It bears noting that the long-term reliability problem cannot be solved simply by substituting such low-Vt PFETs P6 and P7 with high-Vt devices having a thicker oxide and longer channel length. Such substitution would drastically degrade the performance of the comparator because high-Vt devices used in the place of transistors P6 and P7 would not be capable of accurately mirroring the current from the corresponding low-Vt devices P3, P4 to which their gate terminals are tied. When there is a mismatch in the threshold voltages, the comparator circuit 40 fails at some worst process corners.

SUMMARY OF THE INVENTION

Various ways are provided for reducing the voltage stress applied to the drain to source conduction path of an FET and/or to reduce the stress to the gate oxide of an FET which may have a thin gate oxide. Alternatively, in the circuits provided herein, ways are provided for avoiding differences in voltage stresses that could cause threshold voltages to change over time, leading to transistors in which threshold voltages no longer match.

Thus, in a current mirror circuit disclosed herein, a first field effect transistor (FET) has a first gate and a first drain, in which the first drain is conductively connected to a current source for conducting a first current. The current mirror circuit also includes at least one second FET having a second gate conductively connected to the first gate, in which the second FET is operable to output a second current in fixed proportion to the first current. A switching element having a first conductive terminal is connected to the first gate and to the second gate, the second conductive terminal being connected to the first drain of the first FET. A switching network is operable to controllably switch the first and second FETs and the third switching element between a powered on state in which the first and second currents are conducted, and a powered off state in which the first and second currents are not conducted and in which the third switching element is open, i.e., in a turned off (nonconducting) condition.

DETAILED DESCRIPTION

Accordingly, various ways are provided herein for reducing differences in the magnitudes of stresses applied to NFET and PFET devices of the same circuit.

Figure 5:
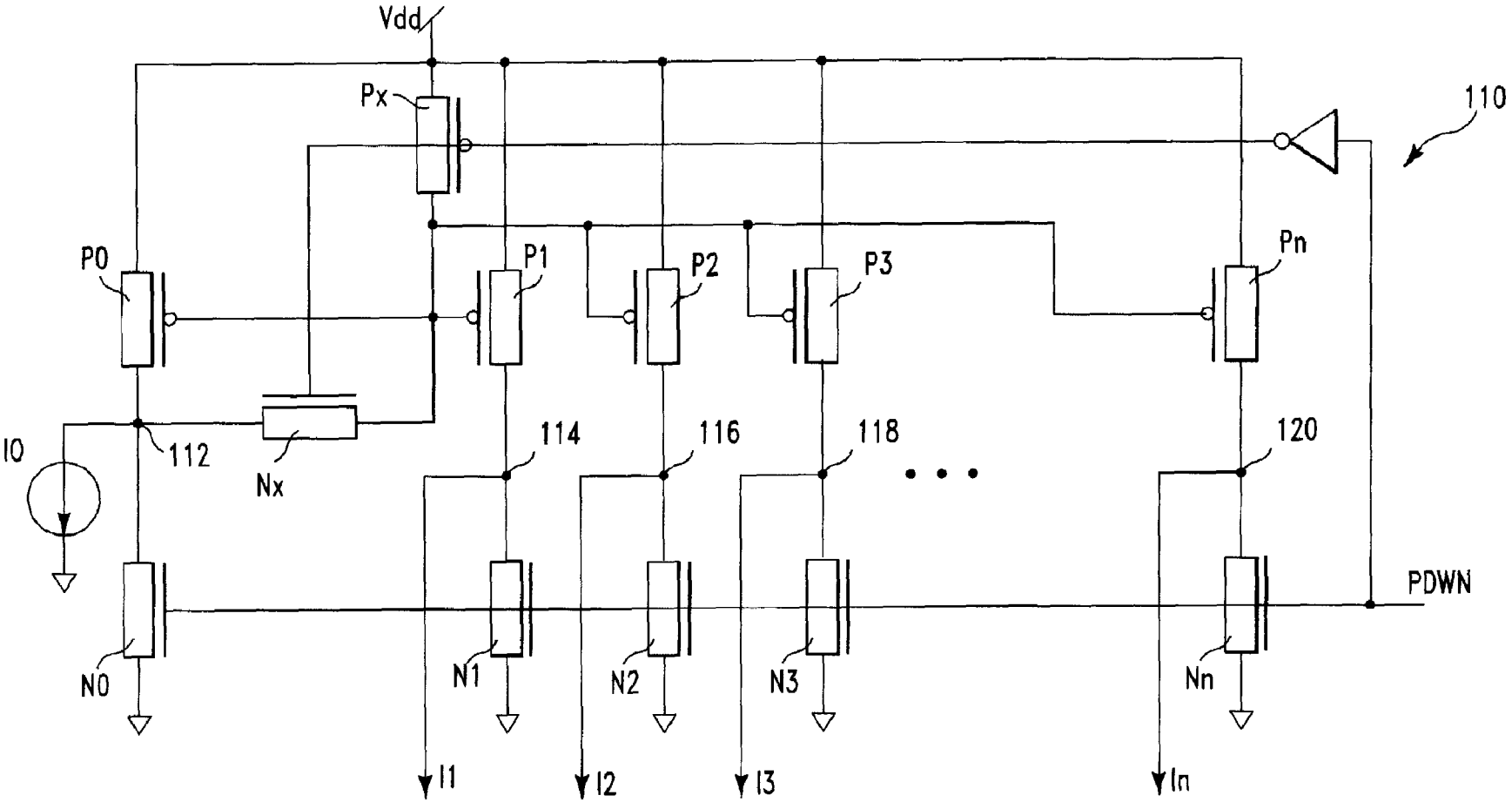
FIG. 5 is a schematic diagram illustrating a current mirror circuit according to an embodiment of the invention.

Thus, in the embodiment of the invention shown in FIG. 5, a current mirror circuit 110 is provided in which the stresses applied to the master device P0 are substantially the same as the stresses applied to the slave devices P1, P2, P3 . . . Pn. In this way, better tracking is maintained between the threshold voltage of the master device and the slave devices.

In order to ensure that the slave devices are stressed the same as the master device, the improved current mirror circuit 110 is modified from the prior art current mirror circuit 10 (FIG. 1) by the addition of two NFETS N0 and Nx. Conceptually, the improvement lies in the addition of at least one switching element to equalize the stresses on two or more devices for which matching threshold voltages are desired to be maintained. NFET N0 operates to pull down the voltage at the drain of master device P0 to ground when the circuit is powered down. NFET Nx operates as a passgate to connect the drain of master device P0 to its gate when the circuit 110 is powered on, and to disconnect the drain of device P0 from its gate when the circuit 110 is powered off.

In operation, when the PDWN signal is low, the improved current mirror circuit 110 is powered on. At that time PFET Px is turned off, all of the NFETs Ni (i=0 to n) are turned off, and NFET Nx is turned on, such that the currents through all of the PFETs P1 through Pn mirror the current through PFET P0. On the other hand, the current mirror circuit 110 is powered off when the PDWN signal is high. At that time, the stress applied to the master device P0 is substantially the same as that applied to the slave devices P1 through Pn. When the PDWN signal is high, the PFET Px is turned on, causing all of the PFETs P0 through Pn to be turned off. The PDWN signal also turns on all of the NFETs N0, N1, . . . Nn, causing all of the nodes 112, 114, 116, 118, and 120, etc. to be pulled down to ground, causing currents Io and I1 through In to stop flowing through the circuit. The inverted PDWN signal is also applied to the gate of the passgate device Nx. When the circuit 110 is powered down, passgate Nx is also turned off, disconnecting the drain of the master device P0 from its gate.

Figure 1:
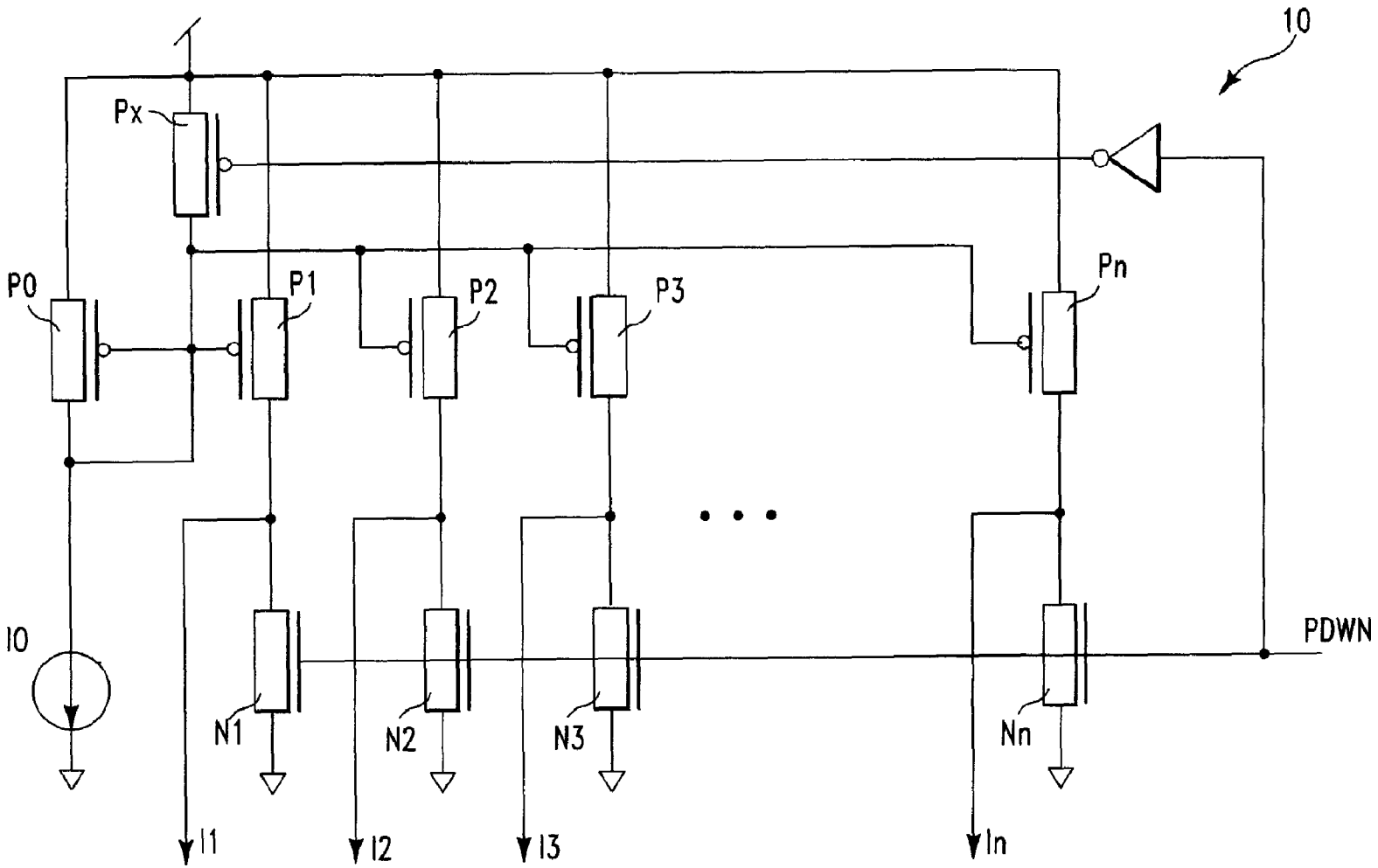
FIG. 1 (Prior Art)
FIG. 1 is a schematic diagram illustrating a current mirror circuit according to the prior art.
Figure 2:
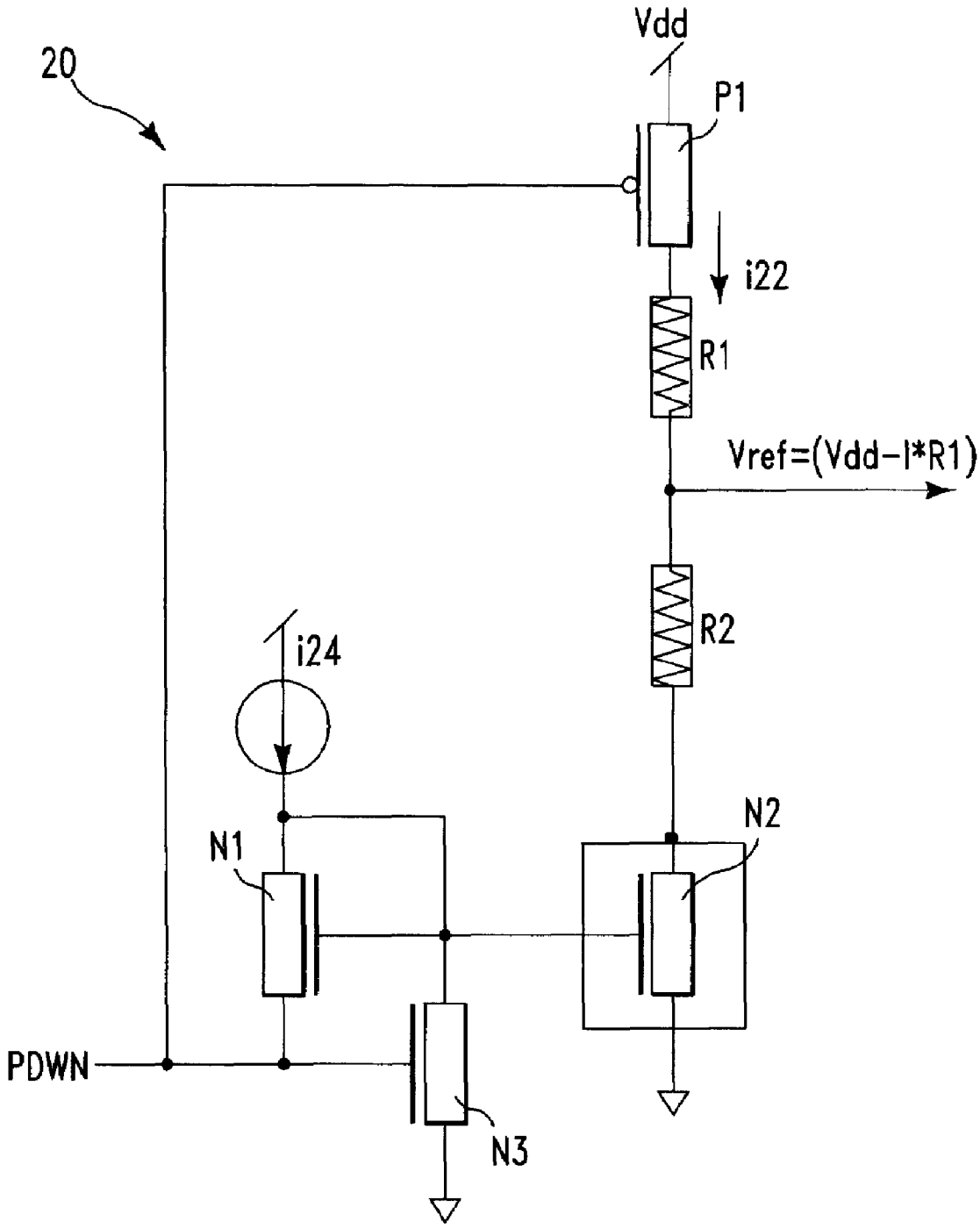
FIG. 2 (Prior Art)
FIG. 2 is a schematic diagram illustrating a voltage reference generator circuit according to the prior art.
Figure 3:
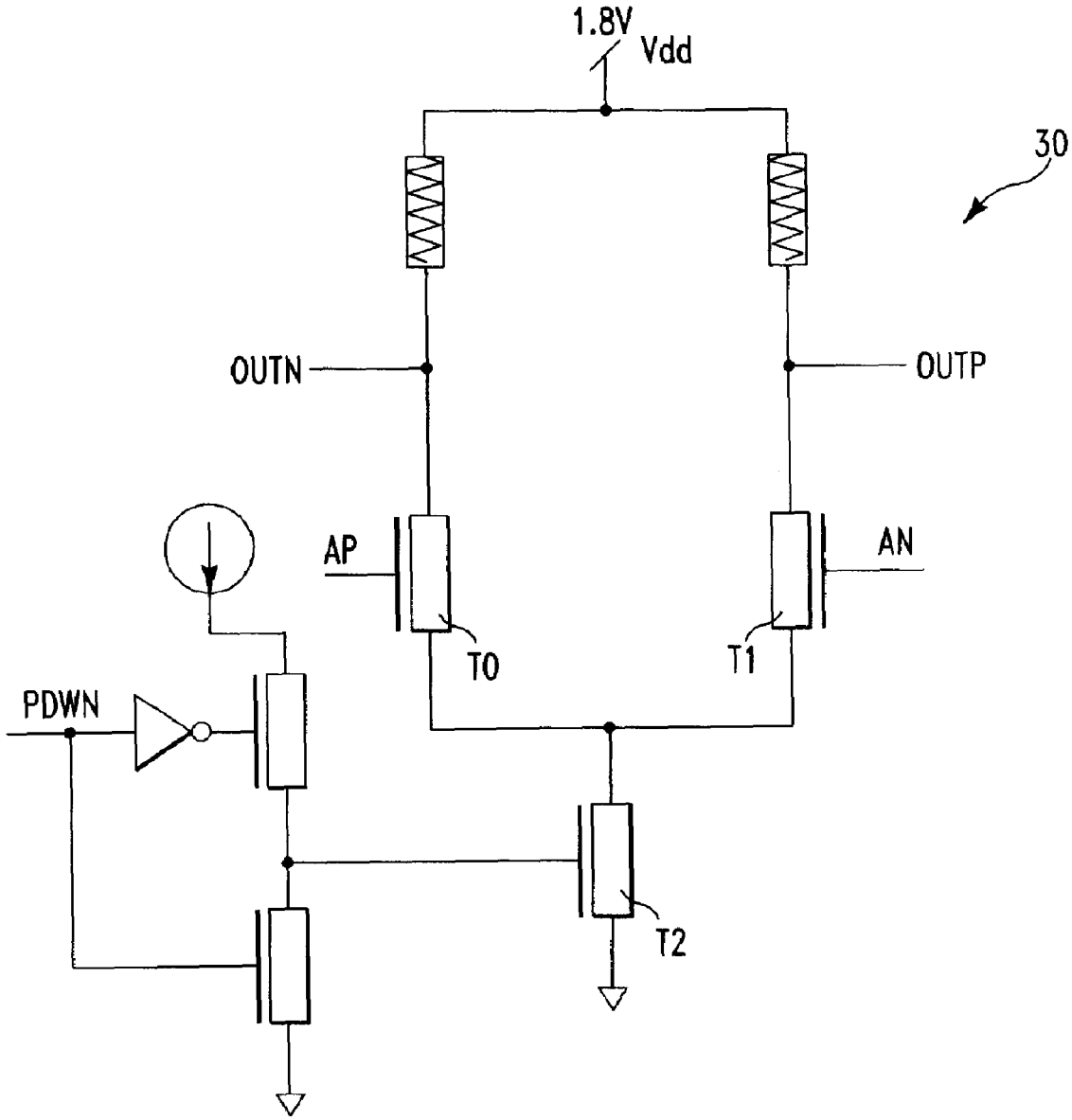
FIG. 3 (Prior Art)
FIG. 3 is a schematic diagram illustrating a differential amplifier circuit according to the prior art.

Thus, as a result of the added devices N0 and Nx, when the improved current mirror circuit 110 is powered down, the magnitude of the gate to drain voltage (Vds stress) applied to the P0 device is not zero as it is in the prior art circuit 10 (FIG. 1). Rather, the gate to drain voltage is made the same as that of the slave PFETs P1 through Pn, which is held at Vdd. Accordingly, whether the circuit 110 is frequently powered down seldom, or not at all, and regardless of the amount of time that circuit 110 remains powered down, the slave PFETS P1 through Pn are all stressed to the same extent as the master PFET P0. This results in maintaining the threshold voltages of the slave PFETs in the same relation to the threshold voltage of the master PFET as they are in the beginning before the circuit 110 is placed in operation and subjected to voltage stress. In this way, circuit 110 preserves threshold voltage matching between the slave PFETS P1 through Pn and the master PFET P0. Note, with respect to this embodiment, that NFETs N0 and Nx can be relatively small devices, such that amount of area required to implement the improvement shown in circuit 110 (i.e., the "area penalty") is relatively small.

Figure 6:
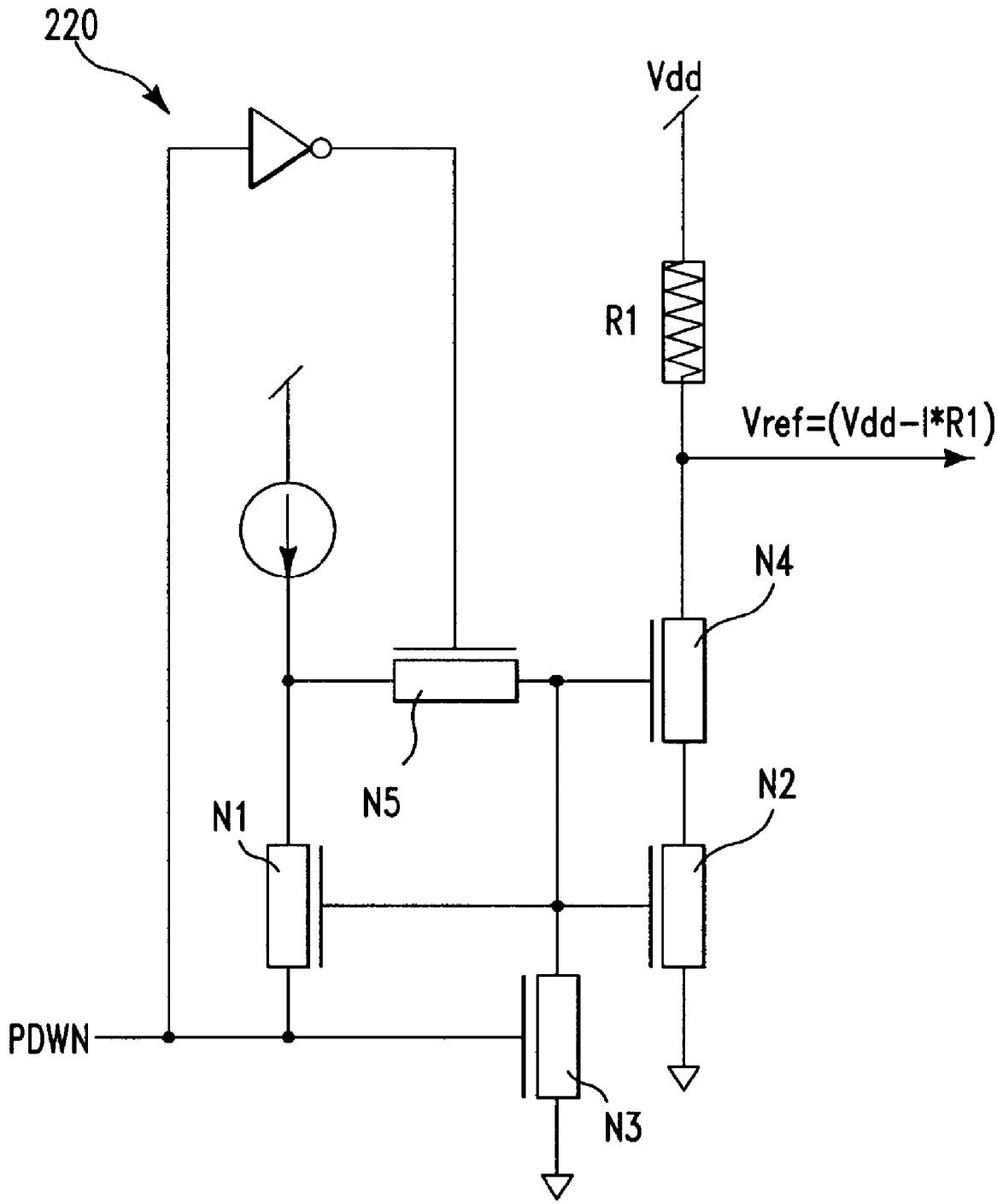
FIG. 6 is a schematic diagram illustrating a voltage reference generator circuit according to an embodiment of the invention.

Similarly, FIG. 6 illustrates a voltage reference generator circuit 220 according to an embodiment of the invention. As shown therein, a switching element in the form of a passgate device N5 is added, the passgate N5 being open, i.e., turned on, when the circuit 220 is operating and closed, i.e., turned off, when the circuit 220 is powered off. In such manner, when the circuit 220 is turned off, the closed passgate device N5 causes the gate to drain voltage applied to the master NFET N1 and the slave NFET N4 to be the same, i.e., Vdd. A further addition to the voltage reference generator circuit 220 is made in form of a device N4 which is stacked in cascade with NFET device N2. The device N4 takes the place of the large size resistor R2 which is used in the prior art voltage reference generator circuit 20. As the device N4 is significantly smaller than the resistor R2, a substantial savings of circuit area is achieved on the chip.

In summary, the circuits 110 (FIG. 5) and 220 (FIG. 6) maintain threshold voltage matching between master and slave FETs by the addition of a passgate switching element Nx in the case of circuit 110 and passgate N5 of circuit 220. In addition, in the circuit 220 the magnitude of the Vds stress applied the NFET N2 is lowered by the addition of a switchable cascaded device N4 placed above N2.

Figure 6A:
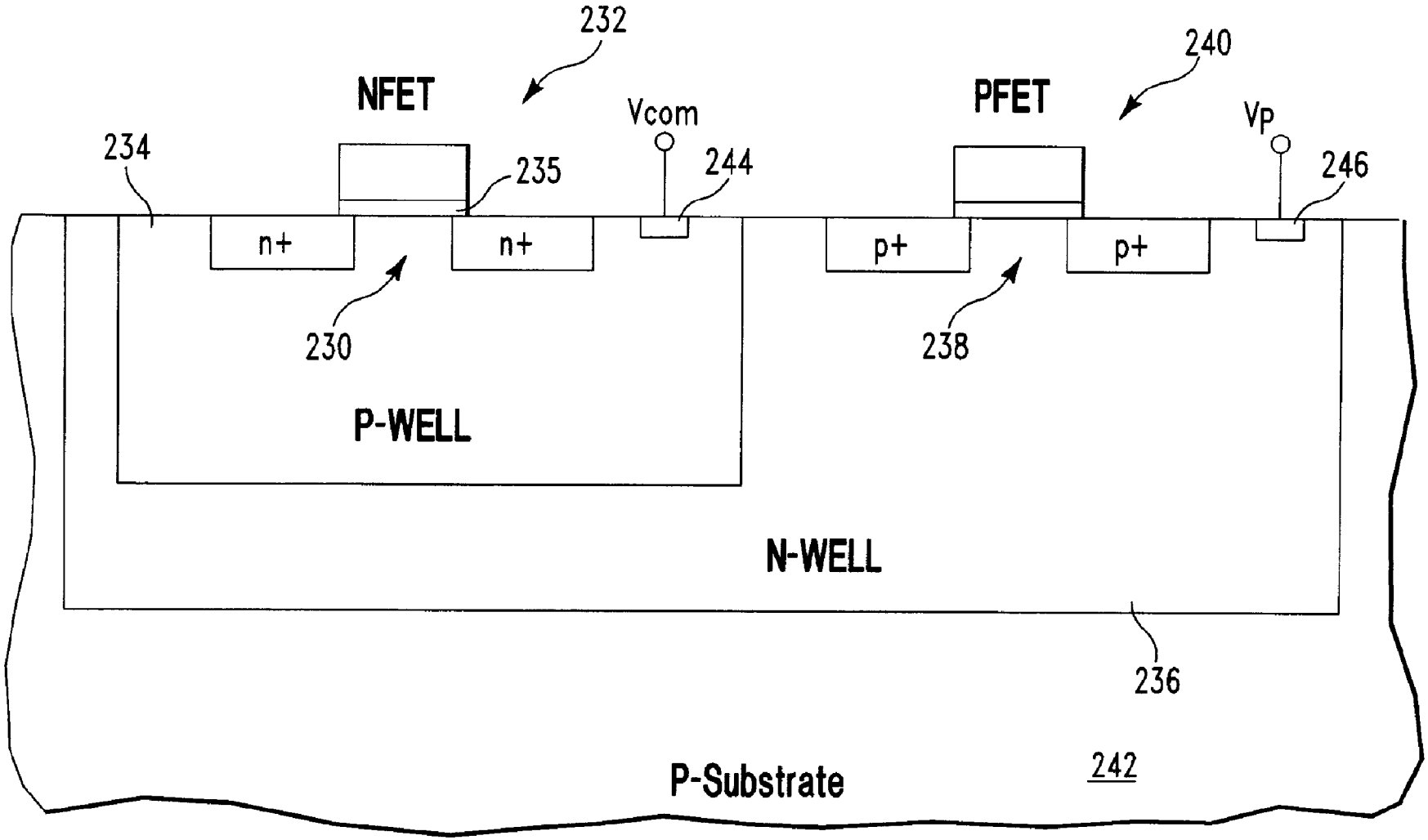
FIG. 6A is a sectional view illustrating a triple well structure in which the body of a field effect transistor is disposed in accordance with an embodiment of the invention.

In a particular embodiment shown in FIG. 6A, the body 230 of a thin gate oxide NFET 232 is disposed in a triple well structure in order to permit a reduction in the voltage stress applied to the gate oxide 235 of the NFET. Namely, the body 230 of the NFET 232 is disposed within a p-well 234, which, in turn, is disposed within an n-well 236, the body 238 of a PFET 240 being disposed in that n-well 236. The n-well 236, in turn, is disposed within the larger p-doped bulk region 242 of the substrate, which accounts for the third "well". Contacts 244 and 246 allow the body 230 of the NFET 232 to be biased separately from the bias applied to other transistors such as to the body 238 of the PFET 240, thus specifically facilitating a reduction in the stress applied to the gate oxide of the NFET. Through such triple-well structure, higher performance can be sought through greater use of low-Vt devices having thin gate oxides.

Figure 7:
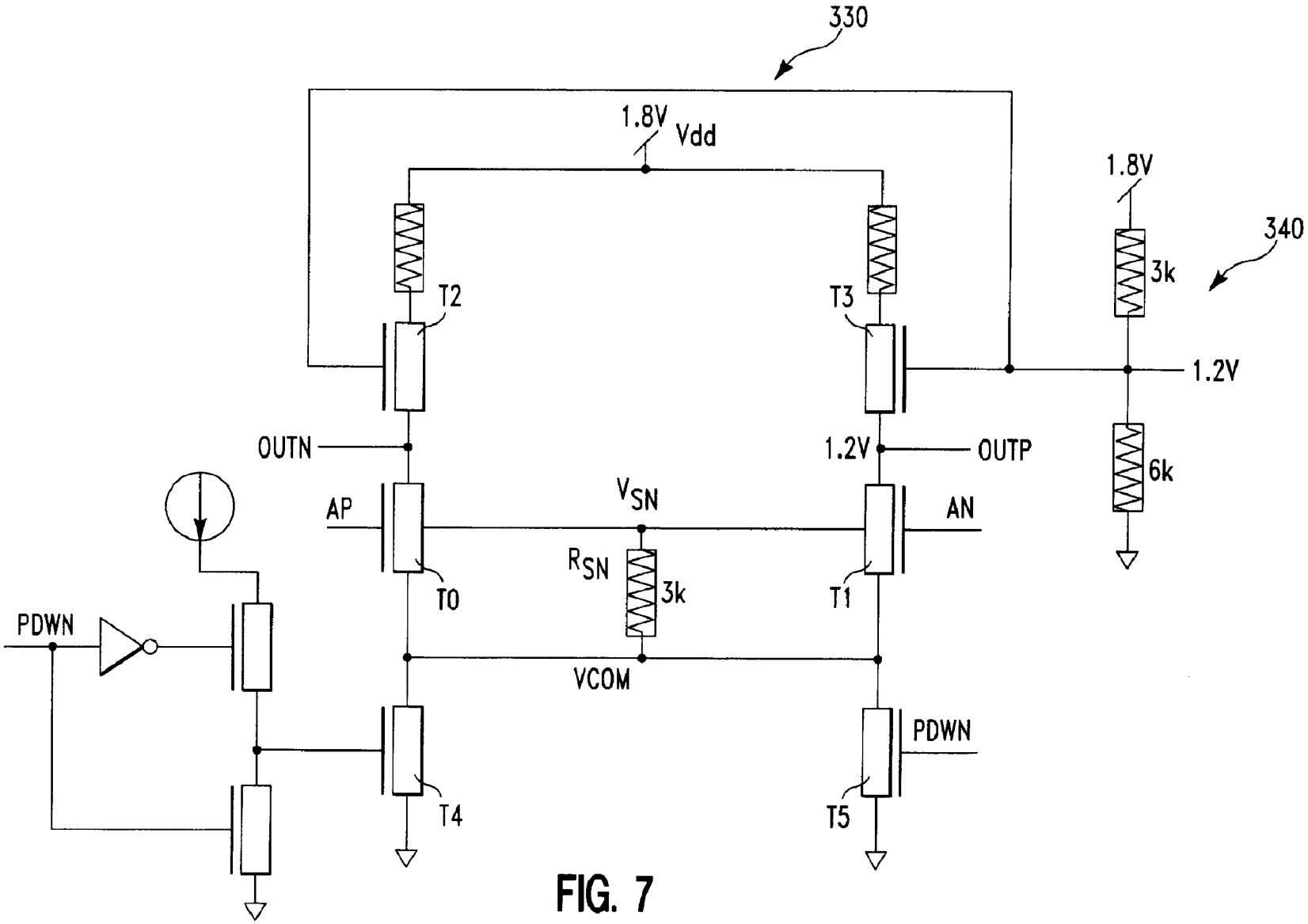
FIG. 7 is a schematic diagram illustrating a differential amplifier circuit according to an embodiment of the invention.

In a third embodiment of the invention shown FIG. 7, a differential amplifier circuit 330 includes input NFETs T0 and T1, which are low Vt, thin oxide devices. In this embodiment, the drain to source voltage stress applied to the low-Vt NFETs T0 and T1 is reduced when the differential amplifier 330 is powered down. The drain to source voltage stress is reduced through a beneficial use of leakage current through the NFETs T0 and T1, when the NFETs T0 and T1 are biased below their threshold voltage.

In this circuit, the bodies of the NFETs T0 and T1 are disposed in triple well structures, as discussed above with reference to FIG. 6A, in which $V_{SN}$ represents the voltage present at the bodies of the NFETs. With the bodies of the NFETs T0 and T1 being disposed in a p-well isolated from the bulk substrate, as shown in FIG. 6A, the bodies of the NFETs can be maintained at a different bias voltage from those of other transistors of the structure. The sources of the NFETs T0 and T1 are tied to the common mode node ("VCOM"). For a particular biasing condition in which the transistors T0 and T1 are off and VSN is more positive than VCOM, the resistance of the conductive path between the bodies of the NFETs and the node VCOM is modeled as a 3 k ohm resistance $R_{SN}$. As described below, leakage current through the NFETs T0 and T1 causes the node voltage VCOM to be higher than ground (e.g., by about 0.4 V) when the differential amplifier circuit 330 is turned off. Because of that, the voltage stress Vgx applied across the gate oxide of the NFETs T0 and T1 is significantly reduced when the differential amplifier circuit 330 is powered down.

As mentioned above, a key feature of the differential amplifier 330 of this embodiment is the use of sub-threshold leakage current to set an internal substrate bias level to thereby reduce the magnitude of the drain to source voltage stress (Vds) of the NFETs T0 and T1. In this embodiment, two low-Vt dummy NFETs T2 and T3 each having a thin gate oxide are inserted in stacked cascaded configuration above the pair of input transistors T0 and T1. A resistive divider circuit 340 is used to establish a proper bias level, e.g., at a level of ⅔ the power supply voltage level Vdd, which is tied to the gates of the pair of dummy NFETs T2 and T3. When the differential amplifier circuit 330 is powered on, the two dummy NFETs are always turned on by a constant bias voltage applied to their gates, such that they function as resistive load elements.

In operation, when the differential amplifier circuit 330 is powered down, as mentioned above, both the input devices T0 and T1 and the tail device T4 are turned off, and the input signals AN and AP are tri-stated, i.e., the providing circuits (not shown) which provide the input signals AN, AP to the differential amplifier circuit 330 are placed in a high impedance state such that the providing circuits do not maintain a voltage on the input signals AN, AP. However, the dummy devices T2 and T3 remain biased for operation, having gate bias voltages set by the resistive divider 340 at ⅔ Vdd. At that time, the PDWN gate bias applied to NFET device T5 provides a tiny path for leakage current passing through the transistors T0 and T1. The result of the sub-threshold leakage through the NFET devices T0 and T1 is to cause the output nodes OUTN and OUTP of the circuit 330 to be clamped at the ⅔ Vdd level, i.e., at 1.2 V when the power supply voltage is 1.8 V, for example. At this time, NFET devices T0 and T1 are turned off more fully than the dummy devices T2 and T3. Under that condition, the sub-threshold leakage through transistors T0, and T1 results in the level at node VCOM rising to a voltage which is close to the quantity $\frac{2}{3}\times Vdd - Ileak*R_{SN}$, where Ileak is the sub-threshold current of NFET device T1 (or device T0) and $R_{SN}$ is the off-resistance of the same device, i.e., the resistance through the transistor T1 when it is turned off by a voltage below its threshold voltage. Due to the increased voltage VCOM which is present at the sources of transistors T0 and T1 at that time, and the lowered voltage (⅔*Vdd) present at the drains of T0 and T1, the drain to source voltage (Vds) stress applied to transistors T0 and T1 is now reduced to a safe level. In addition, because the input signals AN and AP are tri-stated when the circuit 330 is powered down, there is no unsafe gate bias applied to the transistors T0 and T1 at that time.

Figure 4:
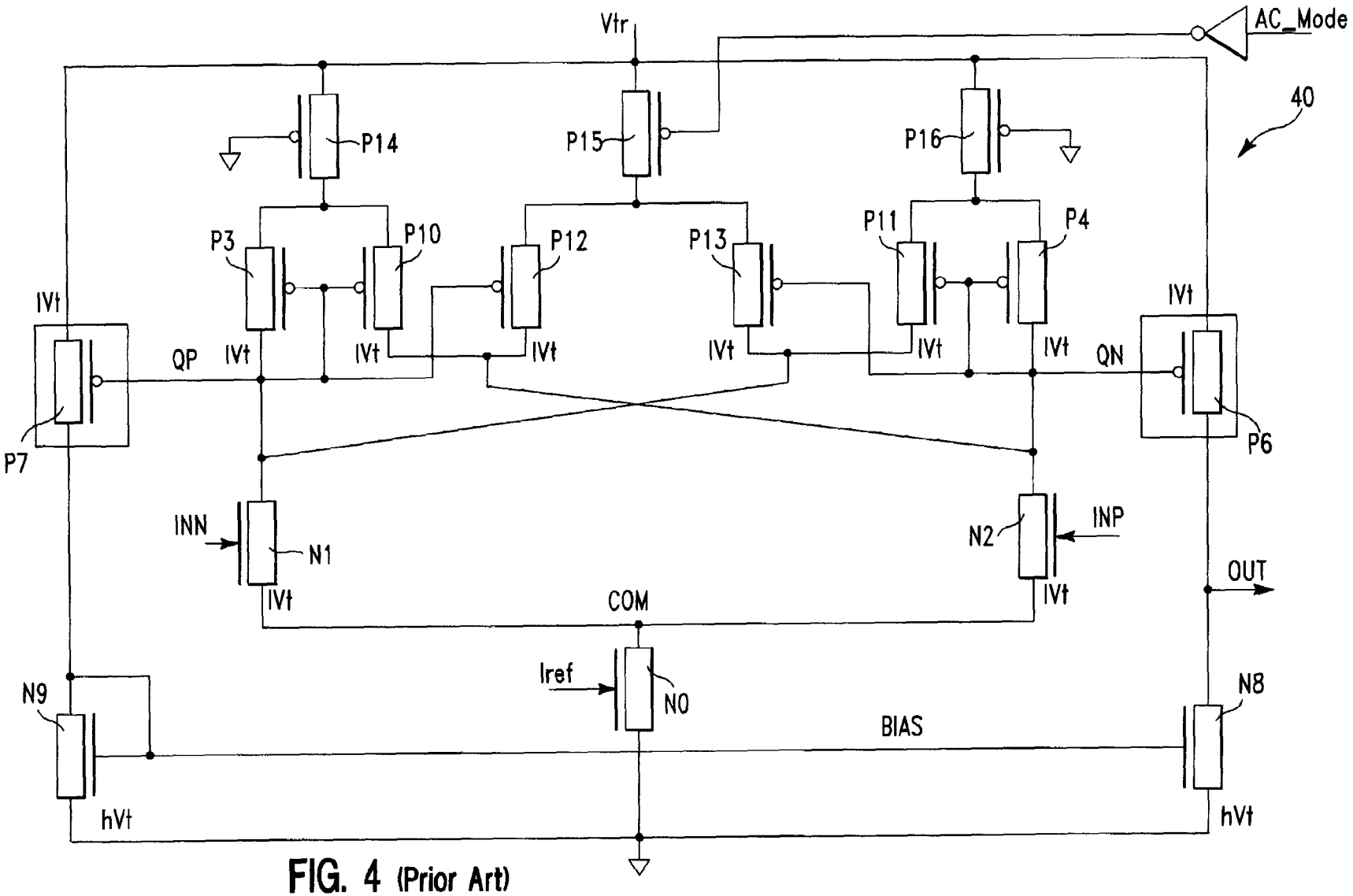
FIG. 4 (Prior Art)
FIG. 4 is a schematic diagram illustrating a hysteresis comparator circuit according to the prior art.
Figure 8:
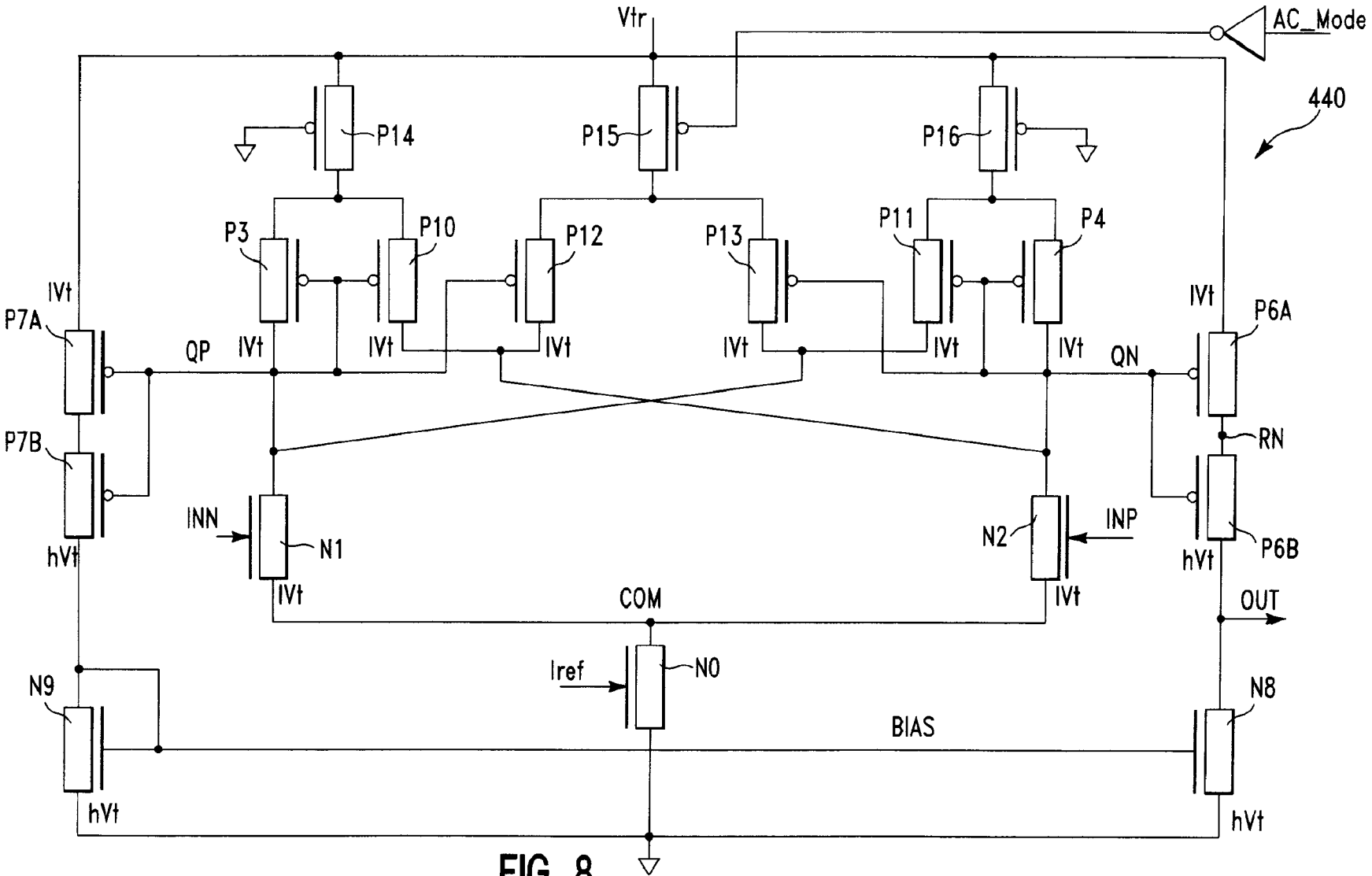
FIG. 8 is a schematic diagram illustrating a hysteresis comparator circuit according to an embodiment of the invention.

FIG. 8 illustrates a fourth embodiment of the invention in which an improved hysteresis comparator circuit 440 which addresses the aforementioned matching and reliability concerns discussed above with reference to FIG. 4. As shown in FIG. 8, in the hysteresis comparator circuit 440, a pair of high-Vt PFETs P6B and P7B are added in a stacked cascaded arrangement having source-drain conduction paths in series with the source-drain conduction paths of the low-Vt devices P6A and P7A, respectively. As before, the low-Vt PFETs P6A and P7A have gates tied to internal nets QN and QP such that they function as slave devices which mirror the currents that are conducted by the master PFETs P4 and P3, respectively. Because both the PFETs P6A, P7A and the PFETs P4, P3 are low-Vt devices, the threshold voltages match, allowing good current mirroring.

Here, the gates of the high-Vt devices P6B and P7B are also tied to internal nets QN and QP, respectively. Here, the high-Vt PFETs P6B and P7B function differently from the low-Vt PFETs P6A, P7A. Since the low-Vt devices turn on at a lower gate bias voltages (at nodes QN, QP), the high-Vt devices are more resistive under that bias condition, such that the high-Vt devices function as resistive load elements, over which most of the voltage drop in each leg of the circuit occurs. In this way, the high Vt PFETs P6B and P7B are subjected to higher Vds stress than the low Vt PFETs P6A and P7A which are subjected to comparatively little Vds stress, thus protecting the low Vt PFETs from harm.

The hysteresis comparator circuit 440 operates as follows. The inputs INP and INN are differential inputs which together represent one signal, as received in a receiver complex from a transmission line. When the input voltage at INP is greater than the input voltage at INN, the internal voltage at node QN starts to drop, and the internal voltage at node QP rises, causing the voltage at the node "BIAS" to fall. At that moment, both of the PFETs P6A and P6B are turning on, and NFET N8 is turning off, such that the output voltage at node "OUT" is rising towards the power supply voltage Vtr. In this circuit, NFET N8 is a high-Vt transistor, allowing it to bear the Vds stress up to the full Vtr level.

On the other hand, when the input voltage at INP is lower than the input voltage at INN, the voltage at node QN rises, while the voltage at node QP falls, which in turn causes the voltage at the BIAS node to rise. At that moment, both of the PFETs P6A and P6B are turning off, and the tail device N8 is turning on, causing the voltage at the output node (OUT) to fall towards ground. When both PFETs P6A and P6B are turning off, the intermediate node RN remains at a voltage level close to the power supply voltage (Vtr). Since PFET P6B has high Vt, it can sustain the full drain to source voltage stress up to the magnitude of the power supply voltage Vtr. However, under these conditions, the low-Vt PFET P6A is not stressed at all since both the drain and the source of the low-Vt PFET P6A are maintained at the level of the power supply voltage (Vtr).

With the additional high-Vt devices P6B and P7B added in series with the low-Vt devices, the performance of the hysteresis comparator 440 is preserved while substantially eliminating the Vds stress applied to the low-Vt devices P6A and P7A. This is also accomplished without requiring an additional external bias generator. Internal bias provided to transistor N8 from transistor N9 also properly reduces the gate to drain stress of the low-Vt PFETs P6A and P7A.

While the invention has been described in accordance with certain preferred embodiments thereof, those skilled in the art will understand the many modifications and enhancements which can be made thereto without departing from the true scope and spirit of the invention, which is limited only by the claims appended below.

What is claimed is:

1. A current mirror circuit, comprising:

a first field effect transistor (FET) having a first gate and a first drain, said first drain conductively connected to a current source for conducting a first current;

at least one second FET having a second gate conductively connected to said first gate, said second FET operable to output a second current in proportion to said first current; and a switching element having a first conductive terminal connected to said first gate and to said second gate, a second conductive terminal connected to said first drain and a control terminal for receiving a control input, such that (a) when the control input has a first state, said switching element is operated in an "on" state to conduct current between said first and second conductive terminals, and (b) when the control input has a second state, said switching element is operated in an "off" state not conducting current between said first and second conductive terminals; and a switching network operable to provide the control input to said switching element and controllably switch said first and second FETs between a powered on state in which said switching element is in the on state and the first and second currents are conducted and a powered off state in which said switching element is in the off state and the first and second currents are not conducted.

2. The current mirror circuit as claimed in claim 1, wherein during the powered off state a first voltage between said first gate and said first drain is substantially the same as a second voltage between said second gate and a drain of said second FET.

3. The current mirror circuit as claimed in claim 2, wherein during the powered off state said switching network connects said first drain and said drain of said second FET.

4. The current mirror circuit as claimed in claim 1, wherein said FETs are insulated gate field effect transistors (IGFETs) and said first and second gates are insulated gates of said IGFETs.

5. The current mirror circuit as claimed in claim 3, wherein said switching network includes first and second pull-down FETs coupled to switchably connect said first drain and said drain of said second FET to ground.

6. The current mirror circuit as claimed in claim 1, wherein said first and second FETs are n-type FETs, said n-type FETs having bodies disposed in at least one well region of a substrate, said well region being biasable independently from another region of said substrate.

* * * * *